United States Patent [19]

Lagues et al.

[11] 3,960,421

[45] June 1, 1976

[54] METHOD OF MANUFACTURING A NON-THERMALLY EMITTING ELECTRODE FOR AN ELECTRIC DISCHARGE TUBE

[75] Inventors: Michel Lagues, Sceaux; Jean-Louis Domange, Antony, both of France

[73] Assignee: U.S. Philips Corporation, New York, N.Y.

[22] Filed: Jan. 3, 1975

[21] Appl. No.: 538,326

Related U.S. Application Data

[63] Continuation of Ser. No. 344,264, March 23, 1973, abandoned.

[30] Foreign Application Priority Data

Mar. 27, 1972 France ..... 72.10659
Mar. 27, 1972 France ..... 72.10660

[52] U.S. Cl. ..... 316/17; 29/25.17
[51] Int. Cl.[2] ..... H01J 9/02
[58] Field of Search ..... 29/25.14, 25.17; 313/94; 117/219, 223, 224, 225; 316/8, 3, 12, 13, 17, 18, 19, 26; 427/74, 77

[56] References Cited

UNITED STATES PATENTS

| | | | |
|---|---|---|---|
| 2,184,323 | 12/1939 | Spanner | 117/225 |
| 2,192,418 | 3/1940 | Sommer | 316/1 X |
| 2,206,372 | 7/1940 | Sommer | 316/12 X |
| 2,840,751 | 6/1958 | Meister et al. | 117/225 X |
| 3,387,161 | 7/1968 | Van Laar et al. | 313/94 |
| 3,425,111 | 2/1969 | Denison, Jr. | 29/25.17 |
| 3,630,587 | 12/1971 | Garbe et al. | 316/12 |
| 3,769,536 | 10/1973 | Antypas et al. | 313/94 |

*Primary Examiner*—Roy Lake
*Assistant Examiner*—James W. Davie
*Attorney, Agent, or Firm*—Frank R. Trifari; Leon Nigohosian

[57] ABSTRACT

Monoatomic layers to reduce the work function of photocathodes, secondary emission electrodes and field emission electrodes are obtained by surface segregation as a result of a thermal treatment after preceding indiffusion of the activator. Examples are in particular p-semiconductors such as silicon and III-V compounds with alkali metals.

12 Claims, 1 Drawing Figure

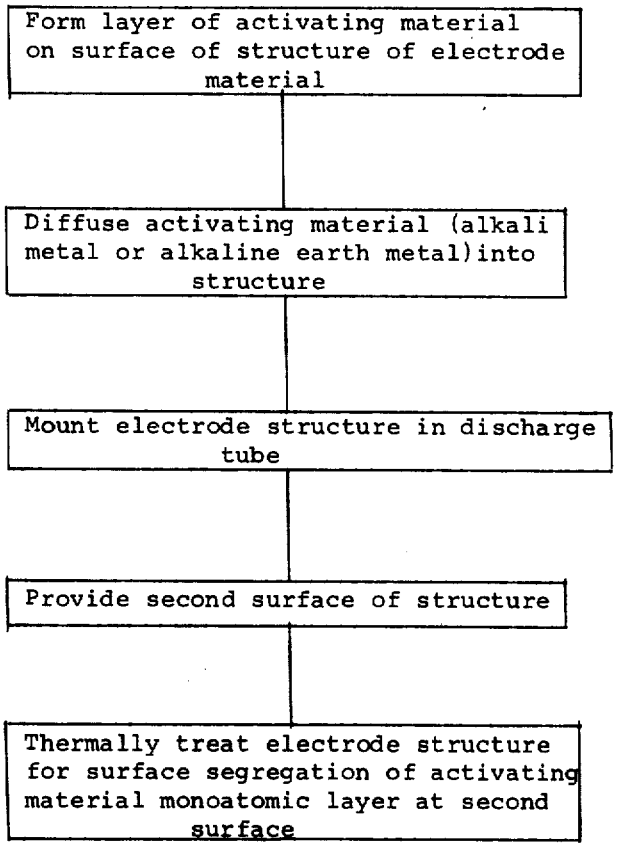
Form layer of activating material on surface of structure of electrode material
Diffuse activating material (alkali metal or alkaline earth metal) into structure
Mount electrode structure in discharge tube
Provide second surface of structure
Thermally treat electrode structure for surface segregation of activating material monoatomic layer at second surface

METHOD OF MANUFACTURING A NON-THERMALLY EMITTING ELECTRODE FOR AN ELECTRIC DISCHARGE TUBE

This is a continuation of application Ser. No. 344,264, filed Mar. 23, 1973, now abandoned.

The invention relates to a method of manufacturing a non-thermally emitting electrode which is activated with a thin layer of alkali metal or alkaline earth metal. The invention furthermore relates to an electric discharge tube comprising an electrode manufactured in this manner.

Vapour deposition is the conventional method of covering a photocathode or a secondary emission electrode with a monoatomic layer or with several monolayers. Vapour deposition presents several drawbacks. For example, it is very difficult in a completely assembled discharge tube to fully and homogeneously cover the surface of the electrode to be activated in connection with the shape of the electrode and the space available for the evaporation source. The presence of two types of electrodes in a discharge tube, for example, a photocathode and multiplier electrodes which usually consist not only of different electrode material but also require different activation layers, makes it difficult to obtain the desired results. The activation material deposited on the wall of the discharge tube or in other non-desired places also often gives rise to undesired emission or short-circuits. Feedback coupling as a result of light reflection or reflection of electrons also occurs.

A method is known, it is true, in which within a large vacuum space the various types of electrodes are manufactured separately and assembled within said vacuum space, possibly after the passage of a lock, to form a complete tube. However, such a method is cumbersome and expensive. In addition the drawback remains that during the vapour deposition pollution of the activation layer easily occurs as a result of residual gases or gases released during the vapour deposition. Separate particles may also be formed in the tube.

It is an object of the invention to provide an improved method.

The sole FIGURE is a flow chart of the method of manufacturing a non-thermally emitting electrode.

According to the invention, in a method of manufacturing a non-thermally emitting electrode for an electric discharge tube which is activated with a thin layer of alkali metal or alkaline earth metal, said activation material is introduced in the electrode material from without after which the electrode is mounted in the discharge tube, and the activation material is then provided by surface segregation produced by a thermal treatment in a monoatomic layer on the non-polluted surface destined for emission.

A first advantage of the invention is that the number of treatments in the discharge tube itself has become smaller and that the possibility of pollution of the activation layer is smaller. A second advantage is that the heating of the electrode for the surface deposition can be effected in a simple manner by induction or radiation. A third advantage is that the surface deposition results in a homogeneous and monoatomic layer also in the case of geometrically complicated shapes, for example, multiplier electrodes. A further advantage is that the activation layer consists only of the desired material and that segregation also occurs only at said surface by the choice of the diffused part of the electrode material.

A combination of electrode material and activation material preferably is chosen so that the latter is absorbed interstitially in the former and that to such an extent that there may be supersaturation when the assembly is heated at the temperature chosen for surface segregation, namely by carrying out the indiffusion at higher temperature, e.g., in the temperature range of about 150°C and the melting temperature of the electrode material and in a vacuum, neutral atmosphere, or reducing atmosphere. Consequently, the activation material absorbed interstitially in the electrode material is in a metastable condition, while the material deposited at the surface is in a stable condition. During the surface deposition, not more than a monoatomic layer is automatically formed on the surface destined for emission.

In the method according to the invention, the activation material can be incorporated in the electrode material by vapour depositing activation material on the latter and then introducing the activation material in the electrode material by thermal diffusion.

In the method according to the invention it is also possible to cover the electrode material with a suspension of the activation material in a neutral liquid which is evaporated. The electrode material may also be dipped in a non-reactive metal bath in which the activation material is suspended.

In the method according to the invention, the indiffusion of the activation material may be supported by an electric field.

After having provided the electrode material with indiffused activation material, a thick layer thereof will usually still be present at the surface thereof. Said layer can be removed prior to mounting the electrode in the discharge tube, preferably by polishing mechanically, chemically or electrochemically.

In the method according to the invention, the surface of the electrode in the discharge tube can be cleaned by bombarding with ions after mounting said electrode in the discharge tube.

It is also possible to form a clean surface destined for emission by the fission of solid material, in particular a single crystal.

The indiffusion of the activation material in the surface destined for emission is continued until the concentration near the surface is between $1 \times 10^{-6}$ and $10^{4} \times 10^{-6}$.

In order not to arrive at uneconomically long times for the surface deposition, according to the invention the combination of electrode material and activation material and the segregation temperature are chosen to be so that the segregation time which is determined by N, the number of atoms per $cm^2$ in a monolayer of the activation material, and C the initial concentration in atoms per $cm^3$, D the diffusion coefficient of the activation material at the segregation temperature according to the formula $t \geqslant (N/C)^2 \times (1/D)$ is smaller than $10^5$ seconds. So this means 24 hours at the most.

Although the invention may be used with metal electrode material, the method according to the invention has particular advantages if the electrode material is a semiconductor of the p-type, in particular if it is a semiconductor of a III-V compound. Such semiconductors shown the property that, due to band curvature, the Fermi level near the surface is lifted to the upper part of the conduction band. When the activation material shows an electron work function which is equal to or smaller than the distance between the conduction band and the valence band, a particularly favourable photoelectron emission and also a good secondary emission are obtained.

The electrode may be both amorphous polycrystalline or monocrystalline and, in addition to photoelectron emission and secondary emission, field electron emission may also be obtained.

The invention will be described in greater detail with reference to the following example.

The entire surface of a silicon crystal is covered with a suspension of metallic lithium in paraffin oil. After evaporating the oil, the crystal is heated in a vacuum at 400°C, a diffusion of the lithium in the silicon occurring. This operation is repeated three times and the overall duration is 24 hours. The result is that the concentration of the lithium is approximately $10^{-6}$. The silicon body is arranged in a vacuum space and the pressure is reduced to $10^{-10}$ to $10^{-9}$ Torr. In said vacuum a (111) crystal face is formed at the silicon by fission. The crystal is heated at 200°C and a monolayer of lithium is obtained at the fission face after 1 hour. Photoelectron emission can be obtained by means of photons having an energy of 2.5 Volt and a maximum quantum efficiency of 15%. The silicon was of the p-type by means of a boron doping of $10^{14}/cm^3$.

Besides with silicon and lithium, results have also been obtained with gallium phosphide covered with rubidium, potassium or caesium namely as a secondary emission electrode. With an initial concentration of potassium of $10^{18}/cm^3$ it is possible to obtain a monolayer in 1 hour at a temperature of 300°C.

It is to be noted that alloys, for example, of nickel or copper with barium, are already known for spark plugs for combustion engines and for thermal cathodes. In this case, however, the electrodes consist of previously prepared alloys in which a monolayer is not formed by surface deposition.

What is claimed is:

1. A method of manufacturing a non-thermally emitting activated electrode for an electric discharge tube, comprising the steps of:

a. providing a structure of electrode material, said structure having a first surface for electron emission and a layer disposed at said first surface and comprising an activating material;

b. diffusing said activating material into said structure, said activating material consisting essentially of a member selected from the group consisting of an alkali metal and an alkaline earth metal;

c. mounting said electrode in the discharge tube; then, d. providing a second surface of said structure substantially not polluted by said activating material; and e. thermally treating at a first temperature the structure thus produced to achieve surface segregation of said activating material at said second surface as a monoatomic layer thereon.

2. A method as in claim 1, comprising the step of diffusing said activating material into said electrode structure at a certain temperature exceeding said first temperature to supersaturate said electrode structure at said first surface.

3. A method as claimed in claim 1, wherein said layer is produced by vapor deposition.

4. A method as in claim 1, wherein said layer comprises a suspension of activating material in a neutral liquid and said method further comprises the step of evaporating said liquid.

5. A method as in claim 1, wherein said layer is produced by dipping the electrode structure in a non-reactive metal bath containing said activating material suspension.

6. A method as in claim 1, wherein said electrode structure is subjected to an electric field during the step of diffusing said material.

7. A method as in claim 1, wherein between said steps of indiffusing said activating material and thermally treating said electrode structure at said first temperature, said electrode structure is polished at said first surface at least one of mechanical, chemical, and electro-chemical polishing techniques.

8. A method as in claim 1, wherein between said steps of indiffusing said activating material and thermally treating said electrode structure at said first temperature, said electrode structure is subjected to ion bombardment at said second surface to achieve cleaning thereof.

9. A method as in claim 1, wherein said structure comprises a single crystal and said second surface is formed by means of a fission of said single crystal.

10. A method as in claim 1, wherein said certain temperature is in the range between 150°C and the melting temperature of the material of said electrode structure and said thermal treatment is carried out in one of a vacuum, a neutral atmosphere, and a reducing atmosphere.

11. A method as in claim 1, wherein such indiffusion is continued until the concentration of said activating material at said first surface is between about $1 \times 10^{-6}$ and $10^4 \times 10^{-6}$.

12. A method as in claim 1, in that if N is the number of atoms per $cm^2$ in a monoatomic layer of the activation material and C is the initial concentration in atoms per $cm^3$ near the surface and D is the diffusion coefficient of the activation material at the segregation temperature, the activating and electrode structure materials, the concentration, and the temperature are chosen to be so that the time, t, which is required for the surface segregation satisfies the formula $t \geq (N/C)^2$ and is less than $10^5$ seconds.

* * * * *